7/20/76 XR 3,970,462

United States Patent [19]

Stillman

[11] 3,970,462

[45] July 20, 1976

[54] SELF SETTING MOLDING PROCESS

[75] Inventor: Neil W. Stillman, Madison, Ohio

[73] Assignee: Diamond Shamrock Corporation, Cleveland, Ohio

[22] Filed: Feb. 25, 1974

[21] Appl. No.: 445,558

Related U.S. Application Data

[63] Continuation-in-part of Ser. No. 355,879, April 30, 1973, abandoned.

[52] U.S. Cl. ..... 106/38.35; 106/38.3; 106/74; 106/84; 164/23

[51] Int. Cl.[2] ..... B28B 7/34

[58] Field of Search ..... 106/38.3, 38.35, 74, 106/84; 164/23

[56] References Cited

UNITED STATES PATENTS

| | | | |
|---|---|---|---|
| 2,492,790 | 12/1949 | Farkas et al. | 106/74 |
| 2,952,553 | 9/1960 | Ilenda et al. | 106/38.3 |
| 3,642,503 | 2/1972 | Beaney | 106/38.35 |

*Primary Examiner*—Lorenzo B. Hayes
*Attorney, Agent, or Firm*—William A. Skinner

[57] ABSTRACT

Self setting molds for metal casting are produced using a liquid alkali metal silicate as the binder and a product obtained by reaction of three moles of glycerin and one mole of glacial acetic acid as the catalyst for the binder.

6 Claims, No Drawings

SELF SETTING MOLDING PROCESS

CROSS-REFERENCE TO RELATED APPLICATION

This is a continuation-in-part of co-pending application Ser. No. 355,879 filed Apr. 30, 1973 now abandoned.

BACKGROUND OF THE INVENTION

1. Field of the Invention

This invention relates to an improved process for producing metal casting molds using an alkali metal silicate as the binder and a product obtained by reaction of three moles of glycerin and one mole of glacial acetic acid as the catalyst for the binder.

2. Description of the Prior Art

In recent years there has been considerable interest in the production of self setting molds for metal casting from aggregates and liquid alkali metal silicates where the molds are formed in desired shapes and then cured by exposure to carbon dioxide gas. Curing of green molds containing an alkali silicate as the binder involves chemical reaction of carbon dioxide with the alkali metal silicate in the mixture to form a uniformly dispersed silicon dioxide gel binder. There are many disadvantages to this type of curing process. It is difficult to insure satisfactory reaction of carbon dioxide with the alkali metal silicate in the green mold. Curing of a large mold is often difficult. Even when carbon dioxide is injected into several sections of a large mold, some portion of the mold may not receive sufficient carbon dioxide to cure properly. Likewise curing of a small mold is difficult. If the alkali metal silicate in a small mold is reacted with an excess of carbon dioxide, the mold may be too friable. Carbon dioxide curing has the further disadvantage that it requires maintenance of a gas supply and storage in cylinders or tanks.

Other methods of curing silicate binders have also been used. Some of these processes are based on silicate reactions which do not require reaction of the silicate with carbon dioxide. One of these processes is described in U.S. Pat. No. 3,642,503 — Beaney, issued on Feb. 15, 1972. This process involves the use of either (1) monoacetin or diacetin and (2) triacetin or ethylene glycol diacetate as the catalyst in the silicate reaction. Although this process represents an improvement over silicate processes which use carbon dioxide, there is still a need for further improvements in processes for self setting molds. Beaney reports that reaction of the alkali metal silicate binder with monoacetin or diacetin catalyst is extremely fast and that it is not possible to prepare a mixture of the silicate binder with the monoacetin or diacetin catalyst and shape a mold before the mixture hardens. Further, Beaney reports that use of a mixture of monoacetin and diacetin as the catalyst does not give satisfactory results with a silicate binder.

SUMMARY OF THE INVENTION

Self setting molds for metal casting are produced using liquid alkali metal silicate as the binder and the product obtained by reaction of three moles of glycerin and one mole of acetic acid as the catalyst. From about 1 to about 10% by weight of a liquid alkali metal silicate having an $SiO_2$ to alkali metal oxide ratio of about 2.0:1 to about 3.3:1 based on the weight of the aggregate is used as the binder and from about 20 to about 40% by weight of the product obtained by reaction of about three moles of glycerin and about one mole of acetic acid based on the weight of the binder is used as the catalyst. Molds are produced by mixing the silicate with the aggregate to obtain a mixture and then adding the catalyst to this mixture, mixing the resulting molding composition, forming a shape and curing the shape at room temperature without using carbon dioxide gas.

DESCRIPTION OF THE PREFERRED EMBODIMENTS

Preferred embodiments include the binder, the catalyst for the binder, the process of producing the molds using the binder and catalyst as well as molds produced by the process.

The liquid alkali metal silicate used as the binder may be an aqueous solution of sodium silicate having a $SiO_2$:$Na_2O$ ratio suitable for bonding an aggregate, e.g., a ratio of about 2.0:1 to about 3.3:1 with the preferred ratio $SiO_2$:$Na_2O$ ratio being about 2.6:1. Various other alkali metal silicates such as potassium silicate and lithium silicate may be used but the sodium silicates are preferred because they are the most readily available and the most economical silicates. However, it should be understood that this invention is not limited to binders containing liquid sodium silicate and encompasses the other alkali metal silicates. "Silicious silicates" having higher silicon dioxide to alkali metal oxide ratios may be used. Likewise liquid alkali metal silicates prepared by adding a finely-divided solid, soluble alkali metal silicate to a liquid alkali silicate may also be used. These silicates are described in U.S. Pat. No. 2,905,563 — Ilenda and Peeler, issued Sept. 22, 1959.

As indicated above, the catalyst is the product obtained by reaction of about three moles of glycerin and about one mole of glacial acetic acid. This product may be prepared by refluxing three moles of glycerin and one mole of glacial acetic and distilling off volatiles at reflux until the temperature in still head drops. This catalyst is used directly without further processing or purification.

The esterification reaction is reproducible and consistently results in formation of a catalyst having excellent curing properties for use in room temperature preparation of aggregate-silicate molds.

The catalyst has been characterized by vapor phase chromatography and can be generally said to have an approximate composition corresponding to 60% glycerin, 35% monoacetin, and 5% diacetin. This analysis can not be considered definitive of the actual catalyst composition due to the equivocal nature of the method of analysis. The catalyst is apparently more complex than the chromatographic analysis indicates, since a simple mixture of 60% glycerin, 35% monoacetin, and 5% diacetin does not function as a satisfactory catalyst.

The term mold is used generically to cover casting forms broadly and includes molds as well as cores. Moreover, the term mold also includes various patterns used in the casting art such as shell mold-forming elements and completed shell mold structures formed by assembling two or more complementary thin-walled shell mold elements as well as hot top molds.

These molds are prepared by mixing the liquid silicate binder with an aggregate to obtain a mixture, adding the catalyst to this mixture, mixing the resulting molding composition, forming a green mold in the desired shape from the molding composition and then allowing the green mold to cure or harden at room temperature.

The aggregate may be a coarse or finely divided refractory material. Sand because of its availability and low cost is widely used in foundry practice. Other finely divided refractory materials such as silica flour may also be used. Coarse aggregates such as gravels and crushed limestone may be used in hot top molds.

While the proportions of aggregate, binder and catalyst may vary, it is usually desirable to use from about 1 to about 10% by weight of the silicate binder based on the weight of the aggregate and from about 20 to about 40% by weight of the catalyst mixture based on the weight of the binder.

For a fuller understanding of the nature and objects of this invention, reference may be made to the following examples which are given to illustrate the invention and are not to be construed in a limiting sense. All percentages, proportions, and quantities given in the example are by weight unless otherwise indicated. Likewise, all references to temperature are as °C unless otherwise indicated.

EXAMPLE 1

A mixture containing a molar ratio of glycerin to glacial acetic acid of 3:1 is prepared and reacted using the following procedure.

This mixture is reacted by heating in a flask equipped with facilities for removing water formed during the esterification by distillation. The mixture is heated initially to 120°C where water formation occurs and is then heated until all of the water produced during the exterification is removed by distillation. Temperature in the distillation head varies between 100° and 105°C.

The product from this esterification reaction is then used as the catalyst for a sodium silicate binder in self setting molds for metal casting. Excellent results are obtained using this catalyst and a liquid sodium silicate having an $SiO_2$ to alkali metal oxide ratio of 2.58:1 as the binder. When desired, a small amount of sugar, from 1 to 10% by weight based on the weight of the silicate is dissolved in the sodium silicate to retard the cure rate slightly and to provide extra control of shake out.

Mold samples are then prepared using Ottawa-70 silica sand as the aggregate. The desired amount of liquid sodium silicate binder is added to the sand and the silicate and sand mixture mixed for 2 minutes. Then the required amount of product of the esterification reaction is added to the aggregate-silicate mixture as the catalyst and then mixed for an additional minute to obtain a mold forming composition. The standard three ram AFS method is then used to prepare "dog biscuit" tensile strength bar specimen and cylindrical green strength specimen from the mold forming composition. Results obtained with mold forming composition Samples A through F are given in Tables 1 and 2.

EXAMPLE 2

A hot top molding composition is prepared by mixing 100g of 10 mesh dolomitic limestone and 50g of air-floated fire clay, then adding 100g of liquid sodium silicate having an $SiO_2$ to alkali metal oxide ratio of 2.84:1 as the binder, mixing for 2 minutes, then adding 30g of the catalyst from Example 1, mixing for 1 minute, shaping in the form of the form of test specimens and curing. This molding composition is satisfactory for use in hot top molds.

EXAMPLE 3

A mixture of 60% by weight glycerin, 35% by weight monoacetin, and 5% by weight diacetin is prepared and used as a catalyst for the preparation of mold samples in lieu of the reaction product catalyst. One thousand grams of Ottawa-70 silica sand aggregate is mixed for two minutes with 35 grams of liquid sodium silicate having an $SiO_2$ to alkali metal oxide ratio of 2.58:1. At this point 8.5 grams of the mixture is added and mixing is continued for one minute to obtain a mold forming composition. Tensile strength and green strength specimens are immediately prepared. The specimens are unsatisfactory for testing, being very friable on the outside and damp on the inside. Such a condition is indicative of a too-rapid cure rate, resulting in an inadequate work life for the composition. Thus unacceptable results are obtained by substitution of a glycerin-monoacetindiacetin mixture for the reaction product catalyst of the invention.

Although the present invention has been described with detailed reference to specific embodiments thereof, it is not intended to be so limited since modifications and alterations therein may be made which are within the complete intended scope of this invention as defined by the appended claims.

TABLE 1

| Sample No. | A | B | C |
|---|---|---|---|
| Ottawa-70 Sand | 1000g | 1000g | 1000g |
| Sodium silicate[a] | 35g | 35g | 35g |
| Product from Esterification Reaction[b] | 10g | 8.5g | 7.5g |
| Green strength psi at 5 min. | 8.5 | 6.0 | 3.0 |
| at 10 min. | 18.75 | 12.1 | 6.7 |
| at 15 min. | >18.75 | 17.8 | 11.3 |
| at 20 min. | — | >18.75 | 13.7 |
| at 25 min. | — | — | >18.75 |

[a]Diamond Shamrock Sodium Silicate - Grade 49FG (2.58:1) containing 40% solids plus 5% dissolved sugar.

[b]Molar ratio of glycerin to acetic acid is 3:1.

TABLE 2

| Sample No. | D | E | F |
|---|---|---|---|
| Ottawa-70 Sand | 1000g | 1000g | 1000g |
| Sodium silicate[a] | 35g | 30g | 25g |
| Product from Esterification Reaction[b] | 10g | 5g | 5g |

TABLE 2-continued

| Sample No. | D | E | F |
|---|---|---|---|
| Tensile strength psi[c] at 24 hr. | 260[d] | 241[e] | 155[e] |

[a]Diamond Shamrock Sodium Silicate - Grade 49FG (2.58:1) containing 40% solids plus 5% dissolved sugar.
[b]Molar ratio of glycerin to acetic acid is 3:1.
[c]AFS tensile strength
[d]Average of 3 determinations
[e]Average of 4 determinations

I claim:

1. In a process for the production of a mold which comprises forming a mixture of an aggregate with 1 to 10 percent by weight of a liquid alkali metal silicate having an $SiO_2$ to alkali metal oxide ratio of about 2.0:1 to 3.3:1, shaping the resulting mixture, and curing the resulting shape at room temperature, the improvement comprising adding to said mixture from about 20 percent to about 40 percent by weight of the silicate of a curing agent prepared by refluxing three moles of glycerin and one mole of glacial acetic acid and distilling off volatiles at reflux until the temperature in the still head drops.

2. The process of claim 1 wherein the aggregate is sand.

3. The process of claim 1 wherein the silicate is sodium silicate.

4. The process of claim 1 wherein the silicate is present in the range of 2.5 to 3.5 percent by weight.

5. The process of claim 1 wherein the $SiO_2$ to alkali metal oxide ratio in the silicate is in the range of 2.5:1 to 3.0:1.

6. A mold produced by the process of claim 1.

* * * * *